US005221075A

United States Patent [19]

Habicht

[11] Patent Number: 5,221,075

[45] Date of Patent: Jun. 22, 1993

[54] SAFETY DEVICE FOR A LIFTING APPARATUS

[76] Inventor: Helmut Habicht, 15 Royal Park Ter., Hillsdale, N.J. 07642

[21] Appl. No.: 609,604

[22] Filed: Nov. 6, 1990

[51] Int. Cl.[5] ..... B66B 5/12; B66B 5/34

[52] U.S. Cl. ..... 254/387; 187/8.5

[58] Field of Search ..... 254/387, 389, 385, 386; 187/8.5

[56] References Cited

U.S. PATENT DOCUMENTS

| | | | |
|---|---|---|---|
| 338,253 | 3/1886 | Deck | 254/387 |
| 2,564,267 | 8/1951 | Manke | 254/387 |
| 4,102,435 | 7/1978 | Hofmann | 187/8.5 |
| 4,328,951 | 5/1982 | Laupper | 187/8.5 |
| 4,531,614 | 7/1985 | Naegeli | 187/8.5 |
| 4,598,506 | 7/1986 | Nohl et al. | 254/387 |
| 4,674,938 | 6/1987 | Van Stokes | 187/8.5 |
| 4,797,050 | 1/1989 | Habicht | 414/420 |
| 4,856,618 | 8/1989 | Isogai | 187/8.5 |
| 4,954,037 | 9/1990 | Habicht | 414/389 |

FOREIGN PATENT DOCUMENTS

| | | | |
|---|---|---|---|
| 1014078 | 4/1952 | France | 254/387 |

*Primary Examiner*—Katherine Matecki
*Attorney, Agent, or Firm*—Patrick J. Pinto

[57] ABSTRACT

A safety device for a lifting apparatus, said lifting device having a carriage member (12) guided in a column (14) said carriage member (12) selectively positioned with respect to said column member (14) by a flexible tension member (20) connected to a drive means (22); a pawl member (34) is disengaged from an elongated rack (62) by a predetermined tension in the tension member (20); A reduction in the predetermined tension in the flexible tension member (20) will automatically engage the pawl member (34) into the rack member (62) by the urging of a biasing member (56) preventing any uncontrolled movement of the carriage relative to the column.

5 Claims, 1 Drawing Sheet

SAFETY DEVICE FOR A LIFTING APPARATUS

FIELD OF THE INVENTION

This invention is believed to be found in the field of Safety Devices and more particularly an automatically responsive pawl and rack safety device for use with a lifting apparatus.

BACKGROUND OF THE INVENTION

Safety Devices for lifting devices are well known. Some examples of known lifting devices are U.S. Pat. No. 4,102,435 as issued to Hofmann on Jul. 25, 1978; U.S. Pat. No. 4,328,951 as issued to Laupper on May 11, 1982; U.S. Pat. No. 4,531,614 as issued to Naegeli on Jul. 30, 1985; and U.S. Pat. No. 4,856,618 as issued to Isogai on Aug. 15, 1989. Each of the previously mentioned U.S. patents disclose safety devices which use a rachet arrangement for limiting the movement of a lifting carriage. It is to be noted that none of the cited art safety devices are automatically responsive to breaking of a flexible tension member such as a roller chain, cable, or the like. It has been determined that there is a need for a safety device which is reactive to any breakage of a flexible tension member. More particularly a flexible tension member which is used to operate a lifting carriage particularly as shown an described in U.S. Pat. No. 4,797,050 and U.S. Pat. No. 4,954,037. U.S. Pat. Nos. 4,797,050, and 4,954,037 are soley owned by the present inventor and are incorporated by reference into the present application to the extent that the present law allows.

SUMMARY OF THE INVENTION

This invention may be summarized at least in part with respect to its objects.

It is an object of this invention to provide and it does provide an automatically responsive safety device for preventing any unwanted movement of a lifting carriage under predetermined conditions.

It is another object of this invention to provide and it does provide a safety device which is automatically engaged as and when a flexible tension member breaks for preventing unwanted movement of a lifting carriage.

It is a further object of this invention to provide and it does provide a safety device for a lifting apparatus which is automatically disengaged by a predetermined amount of tension in a flexible tension member.

It is still another object of this invention to provide and it does provide a safety device for a lifting apparatus which is adaptable to a substantially continuous flexible tension member.

In addition to the above summary, the following disclosure is detailed to insure adequacy and aid in the understanding of this invention. This disclosure, however, is not intended to cover each new and inventive concept, no matter how it may later be disguised either by variations in form or additions by further improvements. For this reason, there has been chosen specific embodiments of a safety device for a lifting apparatus. This safety device is adapted for fixed or mobile lifting apparatus. These specific embodiments have been chosen for the purpose of illustration and description as shown in the accompanying drawings wherein:

BRIEF DESCRIPTION OF THE DRAWING

In the following description and in the claims, various details are identified by specific names for convenience. These names are intended to be generic in their application. The corresponding reference characters refer to like members throughout the several figures of the drawings.

The drawings accompanying and forming a part of this specification disclose certain details of construction associated with a safety device. These details are for the purpose of explanation, but structural details may be modified without departure from the concept and principles of the invention. It is anticipated that this invention may be incorporated in forms other than as shown.

DETAILED DESCRIPTION OF THE PREFERRED EMBODIMENT

Figure 1:
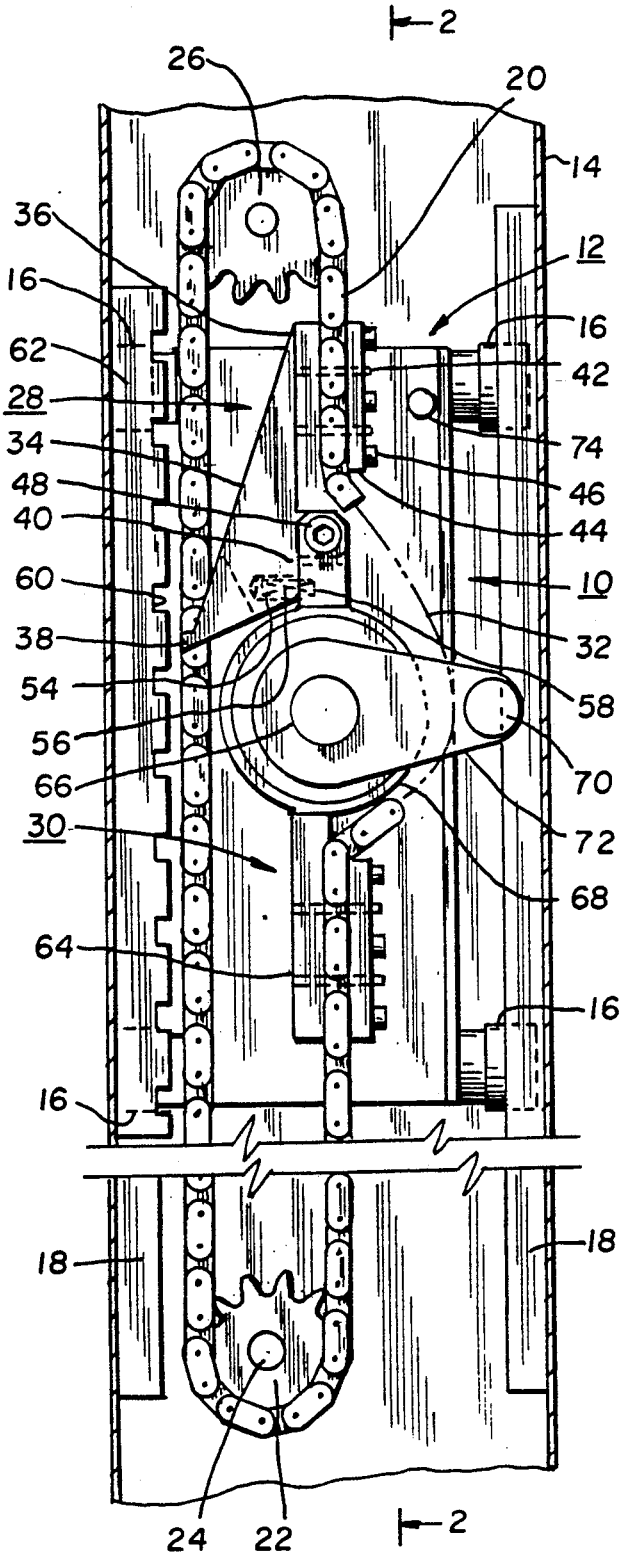
FIG. 1 represents a front elevation view, partly in section, of the safety device of the present invention when mounted in a column of a lifting apparatus, this view showing the safety device in a disengaged position.

Referring to FIG. 1, a safety device, generally identified as 10, is carried on a carriage member 12 of a lifting apparatus, not shown. Typical lifting apparatus are shown and described in U.S. Pat. Nos. 4,797,050 and 4,954,037 which have been issued to the present inventor.

Typically the carriage member 12 is carried and guided in a column member 14. The carriage member 12 is guided in the column 14 by a plurality of guide rollers 16 riding in elongated tracks 18.

Carriage member 12 is selectively lifted, lowered, or held by a flexible tension member 20. For the purpose of this description the flexible tension member 20 is shown as a conventional roller chain. It is anticipated that other types of a flexible tension member may be used such as link chain, cables, rope and the like. The carriage member 12 is selectively lifted, lowered, or held with respect to the column 14 by the movement of the tension member 20 by and with a drive means 22. The drive means 22 is preferrably a drive sprocket carried on a selectively rotated shaft 24. It is anticipated that other drive means such as a linear actuator may be used to lift, lower, or hold the carriage member 12. The tension member 20 is carried on and around an idler sprocket 26.

At least one end of the tension member 20 is connected to the carriage member 12 by means of the safety device 10 of the present invention. Referring to FIG. 1 the tension member 20 is preferably an endless roller chain for providing positive positioning control of the lifting carriage 12. The roller chain type tension member 20 is attached at a first point 28 to the safety device 10 and at a second point 30 to the carriage member 12. A loop 32 is formed between the first point 28 and second point 30. The importance of the loop 32 in an endless tension member 20 will become apparent later in the description.

The first point 28 of the roller chain type tension member 20 in reality is a selected length of the tension member 20. Attachment of the first point 28 to the carriage member 12 is by way of a selectively shaped pawl member 34 of the safety device 10. This pawl member 34 has an attachment portion 36, a latching portion 38, and a biasing portion 40.

The attaching portion 36 preferably retains the first point 28 by means of a pair of hardened dowel pins 42 extending from the attachment portion 36 in a selectively spaced relationship to be inserted between and engage the rollers of the chain 20. A clamping plate 44 is fastened to the attachment portion 36 by a plurality of selectively spaced hardened threaded fasteners 46. These fasteners 46 are also simultaneously inserted into the openings between the rollers of the chain and threaded into the attaching portion 36 of the pawl member 34. This clamp plate 44 provides a positive as well as a friction engagement of the chain 20.

Figure 2:
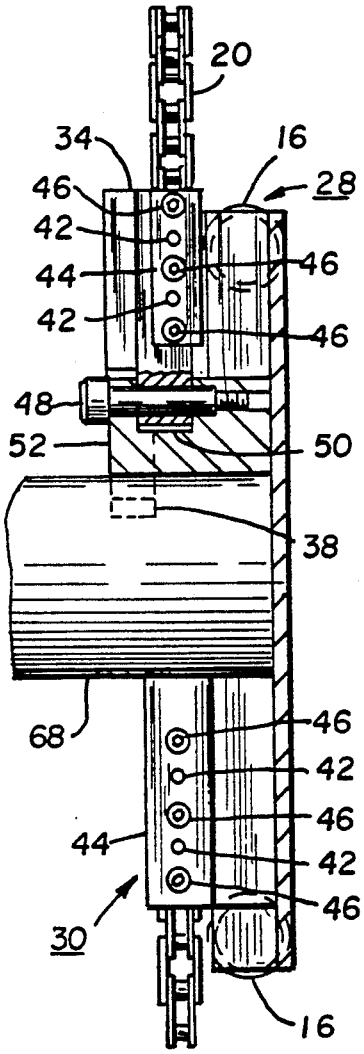
FIG. 2 represents a side view, partly in section, of the safety device, this view taken along line 2—2 of FIG. 1.

The pawl member 34 is pivotally attached to the carriage member 12 by and with a pivot member 48, shown as a conventional shoulder bolt. The pawl member 34 is retained in an notched portion 50 of an attaching block 52. as may be seen in FIG. 2. Preferably this attaching block 52 is welded to the carriage member 12 but any suitable fastening arrangement may be employed.

Referring again to FIG. 1, the biasing portion 40 of the pawl member 34 includes an aperture 54 having a predetermined depth. The aperture 54 is sized to retain a biasing member 56 such as a compression spring. The attaching block 52 also has a blind aperture 58 selectively sized to receive a second end of said biasing member 56. The biasing portion 40 engages the attaching block 52 to limit the counter clockwise rotation of the pawl member 34 to maintain a desired proximity of the pawl member 34 with the rack member 62. This limiting of the counter clockwise rotation also protects the biasing member 56 from overloading, by limiting the compressive stress that may be applied to the spring.

The latching portion 38 of the pawl member 34 is selectively sized to engage selectively spaced and sized tooth members 60 of an elongated rack member 62 when and as the pawl member 34 is pivoted clockwise by the biasing member 56. The rack member 62 is rigidly attached to the column 14 at a selected point by and with a suitable means.

The second point 30 of the tension member 20 is attached to the carriage member 12 by means of a second attachment block 64. The second point 30 employs an attaching arrangement similar to that used and described at the first point 28.

USE AND OPERATION

A carriage member 12 is selectively raised, lowered, or held in a selected position with respect to the column 14. The carriage member 12 may carry a shaft member 66 rotatable in a housing 68. The shaft member 66 is responsive to the engagement of a cam follower 70 of a lever member 72 in a cam track, not shown, but described in U.S. Pat. Nos. 4,797,050 and 4,954,037. It is to be noted that the carriage member may also carry a non rotating type platform.

The carriage member 12 is selectively positioned with respect to the column by the flexible tension member 20. The positioning force in the form of tension in the flexible tension member 20 tends to pivot the pawl member 34 in a counter clockwise manner. This predetermined postioning force holds the latching portion 38 of the pawl member 34 disengaged from the tooth members 60 of the rack 62. The counter clockwise rotation of the pawl member 34 is limited by the biasing portion 40 abutting the attachment block 52.

It can be seen that in the event of a reduction of the tension in the tensioning member 20 to a level below a predetermined tension will result in the pawl member 34 being urged in a clockwise rotation by the biasing member 56. The clockwise rotation of the pawl member 34 results in the engagement of the latching portion 38 with the nearest tooth member 60. The reduction of tension in the tensioning member 20 may be the result of breakage or severing of the tensioning member 20 or a shearing of the idler sprocket from its mounting to the column 14.

The clockwise rotation of the pawl member 34 may be limited by a stop means 74. This stop means may be permanently or adjustably attached to the carriage member. 12.

It is necessary to provide a loop or slack portion 32 between first point 28 and second point 30, when a continuous or endless tensioning member 20 is used, to allow the free movement of the pawl member 34. This loop 32 would be necessary even if a housing 68 were not present on the carriage member 12.

It is to be noted that the safety device of the present invention will also be automatically responsive to the absence of tension in a substantially non-endless tensioning member. The drive means in the form of a linear actuator, pulley sheave or the like, may be located at any point above or below the carriage member 12.

Terms such as "left", "right", "up", down", "bottom", "top", "front", "back", "in", "out", "interior" "exterior" "clockwise", "counter clockwise" and the like are applicable to the embodiments shown and described in conjunction with the drawings. These terms are merely for the purpose of description and do not necessarily apply to the position in which the safety device of the present invention may be used or manufactured.

While these particular embodiments of an improved safety device has been shown and described, it is to be understood that the invention is not limited thereto and protection is sought to the broadest extent the prior art allows,

What is claimed is;

1. A mechanical safety device for a lifting apparatus, said lifting apparatus having a carriage member carried and guided in a column member, said carriage member adapted for either lifting, lowering, or holding by a drive means, said safety device comprising:

(a) an elongated rack member being fastened to an interior wall of said column member at a selected position, said rack member having a plurality of selectively spaced and shaped tooth members;

(b) a selectively shaped pawl member having a latching portion, an attachment portion, and a biasing portion, said pawl member being pivotally mounted to said carriage member by a first attachment block, said first atachment block being secured to said carriage member, said first attachment block being positioned on said carriage member for disengagement of said latching portion from any of said tooth members while abutting said biasing portion when said attachment portion of said pawl member is connected under a predetermined tension to said drive means by a flexible tension members, said flexible tension member being an endless roller chain for the positive lifting, lowering or holding control of said carriage member, all of the tension member being completely enclosed within the column member, said disengagement allowing for the lifting, lowering, or holding of the carriage member relative to the column member; and (c) a compression spring having one of its ends being retained in an aperture in said biasing portion, said aperture having a predetermined depth, a second end of said compression spring being retained in a blind aperture in said first attachment block, said compression spring cooperating with said biasing portion for engagement of said latching portion into one of said tooth members when said flexible tension member is absent said predetermined tension to said drive means, said engagement of said latching portion into one of said tooth members preventing any uncontrolled movement of said carriage member relative to the column member; and wherein a tensioned portion of said endless flexible tension member is attached at a first point to said attachment portion of said pawl member and at a second point to a second attachment block, said second attachment block being mounted to said carriage member in a selectively spaced and substantially vertical alignment with said first attachment portion, to provide a remaining portion of said endless flexible tension member including a slack portion absent tension connecting said first point to said second point, said slack portion allowing for the free engagement of said latching portion into one of said tooth members.

2. A safety device as recited in claim 1 wherein said attachment portion of said pawl member includes a first clamping means for engaging and retaining said first point of said endless flexible tension member.

3. A safety device as recited in claim 1 wherein said second attachment block includes a second clamping means for holding and retaining said second point of said endless tension member.

4. A safety device as recited in claim 3 wherein either said first clamping means or said second clamping means includes at least one pin member for positively engaging a roller of said roller chain.

5. A safety device as recited in claim 1 including a stop means adapted for selective mounting to said carriage member, said stop means for limiting pivotal rotation of the attaching portion of the pawl member thereby controlling the engagement of the latching portion into the tooth member of said rack member.

* * * * *